US008651023B2

(12) United States Patent
Mason et al.

(10) Patent No.: US 8,651,023 B2
(45) Date of Patent: Feb. 18, 2014

(54) HERMETIC COVERING SYSTEM AND METHOD FOR A PROJECTILE

(75) Inventors: James S. Mason, Richardson, TX (US); James S. Wilson, Hurst, TX (US); Jonathan Schmidt, Tucson, AZ (US); Joseph Robson, Tucson, AZ (US); Angel Crespo, Huntsville, AL (US); Rafael Quintero, Vail, AZ (US)

(73) Assignee: Raytheon Company, Waltham, MA (US)

( * ) Notice: Subject to any disclaimer, the term of this patent is extended or adjusted under 35 U.S.C. 154(b) by 885 days.

(21) Appl. No.: 11/946,559

(22) Filed: Nov. 28, 2007

(65) Prior Publication Data

US 2009/0152135 A1 Jun. 18, 2009

Related U.S. Application Data

(60) Provisional application No. 60/867,907, filed on Nov. 30, 2006.

(51) Int. Cl.
*F42B 15/34* (2006.01)

(52) U.S. Cl.
USPC ..... 102/293

(58) Field of Classification Search
USPC ..... 244/1; 102/293, 501, 378, 364; 206/317
See application file for complete search history.

(56) References Cited

U.S. PATENT DOCUMENTS

| | | | | |
|---|---|---|---|---|
| 2,710,096 | A | 6/1955 | Lankford | |
| 3,433,437 | A | 3/1969 | Bates | |
| 3,637,166 | A * | 1/1972 | Nicholson et al. | 244/1 R |
| 3,710,681 | A * | 1/1973 | Koontz | 89/36.14 |
| 3,974,774 | A | 8/1976 | Schaffner et al. | |
| 4,448,130 | A * | 5/1984 | Speer | 102/498 |
| 4,455,917 | A * | 6/1984 | Shook | 89/1.817 |
| H213 | H * | 2/1987 | Panlaqui | 89/1.8 |
| 4,753,169 | A * | 6/1988 | Shores | 102/293 |
| 5,206,989 | A * | 5/1993 | Smith et al. | 29/890.01 |
| 6,098,800 | A * | 8/2000 | Bennish et al. | 206/439 |
| 6,386,296 | B1 | 5/2002 | Kothari et al. | |
| 6,647,888 | B1 | 11/2003 | Cesaroni et al. | |
| D597,309 | S * | 8/2009 | Jongchul | D3/279 |
| 2006/0096485 | A1 | 5/2006 | Stark et al. | |

FOREIGN PATENT DOCUMENTS

| | | |
|---|---|---|
| EP | 1 046 878 | 10/2000 |
| FR | 1 200 122 | 12/1959 |
| GB | 843037 | 8/1960 |

OTHER PUBLICATIONS

PCT Notification of Transmittal of the International Search Report and the Written Opinion of the International Searching Authority, or the Declaration, regarding PCT Application No. US2007/085895 (14 pages), Dec. 5, 2008.

(Continued)

*Primary Examiner* — Michael Carone
*Assistant Examiner* — Reginald Tillman, Jr.
(74) *Attorney, Agent, or Firm* — Cantor Colburn LLP

(57) ABSTRACT

In one embodiment, a hermetic covering system includes a projectile and at least one bag. The projectile has a body and a component that houses moisture-sensitive equipment. The at least one bag may be coupled to the body such that the projectile protrudes through the opening and the component is disposed in the inner cavity to protect the component during storage of the projectile.

23 Claims, 5 Drawing Sheets

(56) References Cited

OTHER PUBLICATIONS

Shumka, Alex, et al., California Institute of Technology, Jet Propulsion Laboratory, Pasadena, California 91103, "*Migrated-Gold Resistive Shorts in Microcircuits*", Reliability Physics Symposium, 1975, 13th Annual, pp. 93-98, Apr. 1975.

Microwave Absorbing Materials, Laird Technologies, www.lairdtech.com, 24 pages, Jan. 17, 2007.

European Patent Office, Communication pursuant to Article 94(3) EPC, Application No. 07 873 640.2-1260, Ref. 004578.1962; transmitted to Baker Botts L.L.P. by Foreign Associate on Aug. 11, 2010, 5 pages, Aug. 11, 2010.

* cited by examiner

THE PERMEABILITY TO MOISTURE OF GLASSES, CERAMICS AND METALS IS ORDERS OF MAGNITUDE LOWER THAN PLASTIC MATERIALS
• SCFS RADOME MATERIAL IS COMPARABLE TO THE PERMEABILITY OF EPOXY

| | ASTM P96 PERMEABILITY g-cm/cm2-hr-Pa |
|---|---|
| SCFS | 3.10E-09 |
| BUTYL RUBBER | 2.00E-11 |
| 5 mil ACLAR | 9.00E-13 |
| 2 mil ALUM FOIL | ~1E-16 |

HERMETIC COVERING SYSTEM AND METHOD FOR A PROJECTILE

RELATED APPLICATION

This patent application claims priority from U.S. patent application Ser. No. 60/867,907, filed Nov. 30, 2006 entitled: HERMETIC COVERING SYSTEM FOR A MISSILE RADOME.

TECHNICAL FIELD

This invention relates generally to projectile systems and more particularly to a hermetic covering system and method for a projectile.

BACKGROUND

It is advantageous for projectiles, such as missiles, to remain in a reliable state of readiness for a period of time. Projectiles are often implemented with equipment which require protection from moisture. The projectile component which houses that equipment is designed to withstand the high temperatures encountered during flight and, in some cases, is also designed to provide good radio frequency (RF) performance. These requirements limit the number and type of materials from which the component can be made. Materials currently used allow moisture to permeate through the large surface area of the projectile.

A possible solution for the moisture problem would be to control the moisture of the entire shipping container. However, shipping containers are not sealed or desiccated to acceptable levels for some equipment on projectiles, like, for example, microwave electronics.

Another possible solution would be to develop material that has high heat tolerance, good RF properties, and a very low permeation rate. However, development of such a material is difficult.

Yet another possible solution would be to apply a moisture barrier coating to the exterior and interior of the projectile. This solution, though, would require a large amount of desiccant material to be placed in the projectile, which would create problems due to the size and weight of the desiccant.

SUMMARY

In one embodiment, a hermetic covering system includes a projectile and at least one bag. The projectile has a body and a component which houses moisture-sensitive equipment. The at least one bag is coupled to the body such that the projectile protrudes through the opening and the component is disposed in the inner cavity to protect the component during storage of the projectile.

The system may include a desiccant disposed between the at least one bag and the component. The projectile may be a missile, the component may be a radome, or the bag may comprise metal foil. In yet another embodiment, the system may further comprise a generally rigid housing disposed over the at least one bag and configured to maintain the at least one bag in a generally fixed position relative to the component.

In another embodiment, a method for a hermetic covering includes coupling at least one bag that has an opening and encloses an inner cavity to a body of a projectile that has a component which houses moisture-sensitive equipment. The at least one bag is coupled to the body such that the projectile protrudes through the opening. The component is disposed in the inner cavity to protect the component during storage of the projectile.

Depending on the specific features implemented, particular embodiments may exhibit some, none, or all of the following technical advantages. Various embodiments may be capable of reducing the amount of periodic maintenance necessary to maintain moisture levels within the projectile component that houses moisture-sensitive equipment below acceptable limits. For example, current military specifications require that the component cavities be stored in environments that are less than 5000 ppm moisture vapor. Given this criterion, particular embodiments may provide an inexpensive solution for maintaining the component within specified limits for a relatively long period of time. Various embodiments may also be capable of reducing the amount of desiccant placed in the projectile itself, which reduces the weight of the projectile. Other technical advantages will be readily apparent to one skilled in the art from the following figures, description and claims.

BRIEF DESCRIPTION OF THE DRAWINGS

Reference is now made to the following description taken in conjunction with the accompanying drawings, wherein like reference numbers represent like parts, and which.

DETAILED DESCRIPTION

Particular embodiments are best understood by referring to FIGS. 1 through 6 of the drawings, like numerals being used for like and corresponding parts of the various drawings.

Figure 1:
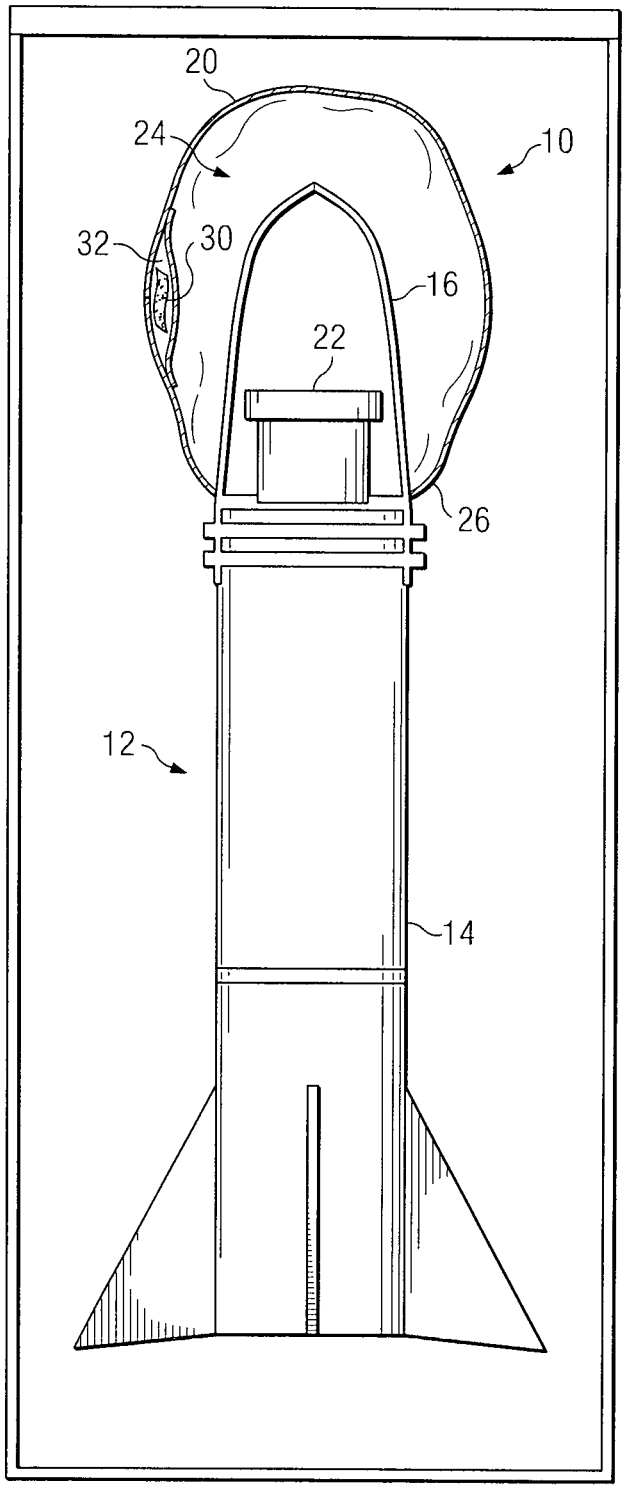
FIG. 1 is a side elevation, cross-sectional view of one embodiment of a hermetic covering system for a projectile.

FIG. 1 shows one embodiment of a hermetic covering system according to the teachings of the present disclosure. Hermetic covering system 10 generally includes a projectile 12 having a body 14 and a component 16 that is disposed in a bag 20. Component 16 houses equipment 22.

In this embodiment, projectile 12 is a missile. Other types of projectiles may be used in other embodiments, such as an aircraft (e.g., a drone), a satellite, or an airborne surveillance device.

In this embodiment, component 16 is a radome, and equipment 22 comprises radio communication devices and electronics. A radome is usually formed of a generally porous and permeable material in order to allow the various sensor devices of the equipment protected by the radome to function properly. In other embodiments, component 16 may comprise housings or coverings for various forms of equipment. In other embodiments, equipment 22 may comprise devices such as electronic circuitry, antenna arrays, photographic equipment, electronic sensors, or other similar types of devices. As will be described in greater detail below, bag 20 may hermetically seal component 16 from humidity or other types of moisture that may damage component 16 or equipment 22 over time.

Bag 20 is formed of a generally thin sheet of material enclosing an inner cavity 24. Bag 20 is sealed to body 14 such that projectile 12 protrudes through an opening 26. The seal helps to prevent moisture from entering into inner cavity 24. Bag 20 may be sealed to body 14 using any suitable approach, such as adhesive, O-rings, metal to metal compression, laser welding, or solder sealing. Hard seals like laser welding will largely eliminate moisture ingress into the cavity through the seal. When encased by bag 20 in this manner, component 16 may be hermetically sealed from moisture or humidity present in the ambient environment. This design gives the advantage of allowing the material chosen for component 16 and projectile 12 to be optimized for other properties without regard to the permeability of the materials. Thus, in one embodiment where component 16 is a radome, the material chosen can be optimized for thermal and RF properties. Another advantage that may be realized in various embodiments is that component 16 may be furnished with inlet and outlet ducts or cooling channels which may allow cooling of equipment 22. Such inlet and outlet ducts or cooling channels may also allow the exhaust of hot air pockets within the cavity.

To reduce the humidity or moisture present in inner cavity 24, a desiccant 30 may be provided. A sealed access cover 32 on bag 20 that allows access to desiccant 30 may also be provided. Desiccant 30 may be any suitable material that has a high affinity for water and may be used as a drying agent. Examples of suitable desiccant materials may include silica gel or calcium oxide. An advantage of this design is seen in various embodiments, as the weight and volume of the desiccant need not be considered in the design of the projectile since the desiccant will be exterior to the projectile. At least one advantage in various embodiments is the ability to perform maintenance on desiccant 30 through sealed access cover 32 (on the surface of bag 20) without disturbing projectile 12.

Sealed access cover 32 may be made of any material that is generally impermeable to moisture including metal, ceramics, and foil lined plastics. Sealed access cover 32 may be coupled to bag 20 in a variety of ways, including using a clamped restraint with an O-ring, a laser weld, or an adhesive bond. In one embodiment, sealed access cover 32 comprises a door within a frame with the frame sealed to bag 20 using a laser weld while using an O-ring seal between the door and the frame.

Figure 2:
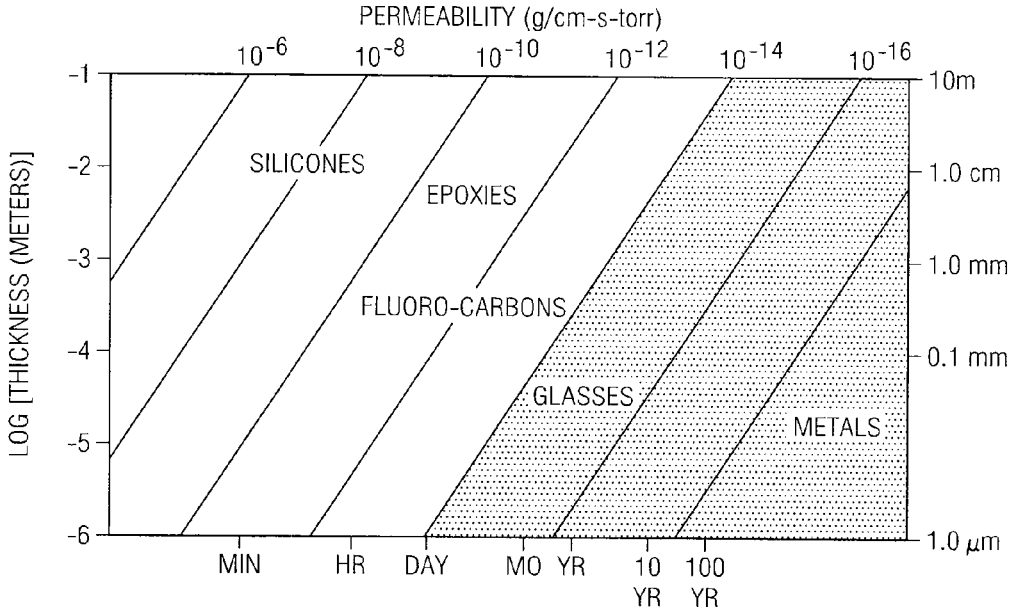
FIG. 2 is a graph showing relative permeability of several materials that may be used to manufacture the bag of the embodiment of FIG. 1.

Bag 20 may be made of any material that is generally impermeable to moisture and that may be quickly torn from projectile 12 when needed. FIG. 2 is a graph showing the relative moisture permeability of several different types of materials. As may be seen, metals have a relatively lower moisture permeability than other commonly known materials. In one embodiment, bag 20 may be made of metal foil. Embodiments incorporating aluminum foil or copper foil may provide an advantage in that relatively good impermeability to moisture may be provided while enabling easy removal when the projectile needs to be launched. Thus in another embodiment, bag 20 may be made of aluminum foil or copper foil. In yet another embodiment, bag 20 may be made of RF absorbing material, such as provided by Laird Technologies located in St. Louis, Mo. under the trade name "Q-ZORB." In yet another embodiment, the type of radio frequency absorbing material may be selected to match the impedance of radio frequency equipment that may be disposed in component 16. In this manner, periodic tests of radio frequency equipment, such as array antennas, may be conducted while bag 20 is disposed on projectile 12.

Figure 3:
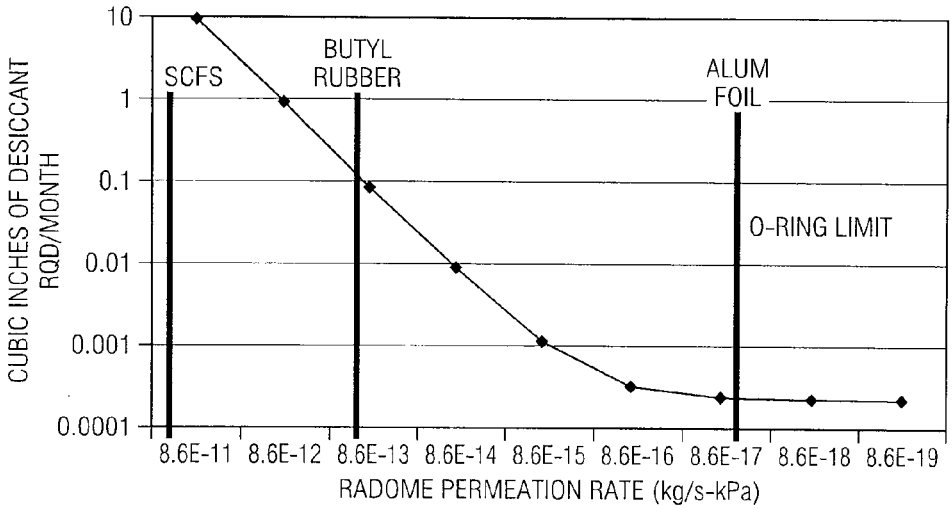
FIG. 3 is a graph showing an amount of desiccant necessary to maintain a component which houses moisture-sensitive equipment at or under 5000 parts-per-million (ppm) of moisture given various types of materials from which the bag is made.

FIG. 3 shows a graph indicating an amount of desiccant necessary to maintain component 16 at or under 5000 parts-per-million (ppm) of moisture given various different types of hermetic enclosures. This comparison of the different types of enclosures is performed using an upper limit of 5000 ppm moisture vapor because military specifications may require moisture levels of equipment 22 typically housed in component 16 to remain below this level. In embodiments where component 16 is a radome, the radome may be made of slip cast fused silica (SCFS) due to its relatively good transparency to electromagnetic radiation. Thus, without bag 20, more than 100 cubic inches of desiccant would be needed per month to maintain the moisture in a component made of slip cast fused silica under 5000 ppm. A metal foil bag reduces the amount of desiccant to 0.2 cubic inches to be used every 15 years. Thus, encasing the component in a bag 20 made of metal may significantly reduce the amount of desiccant necessary to maintain the moisture in component 16 below acceptable levels. The only significant ingress of moisture would come from the seal which attaches bag 20 to body 14 and from the bulkhead of projectile 12; both of these sources of moisture are minimal, however, since their physical area is much smaller than that of component 16.

Figure 4:
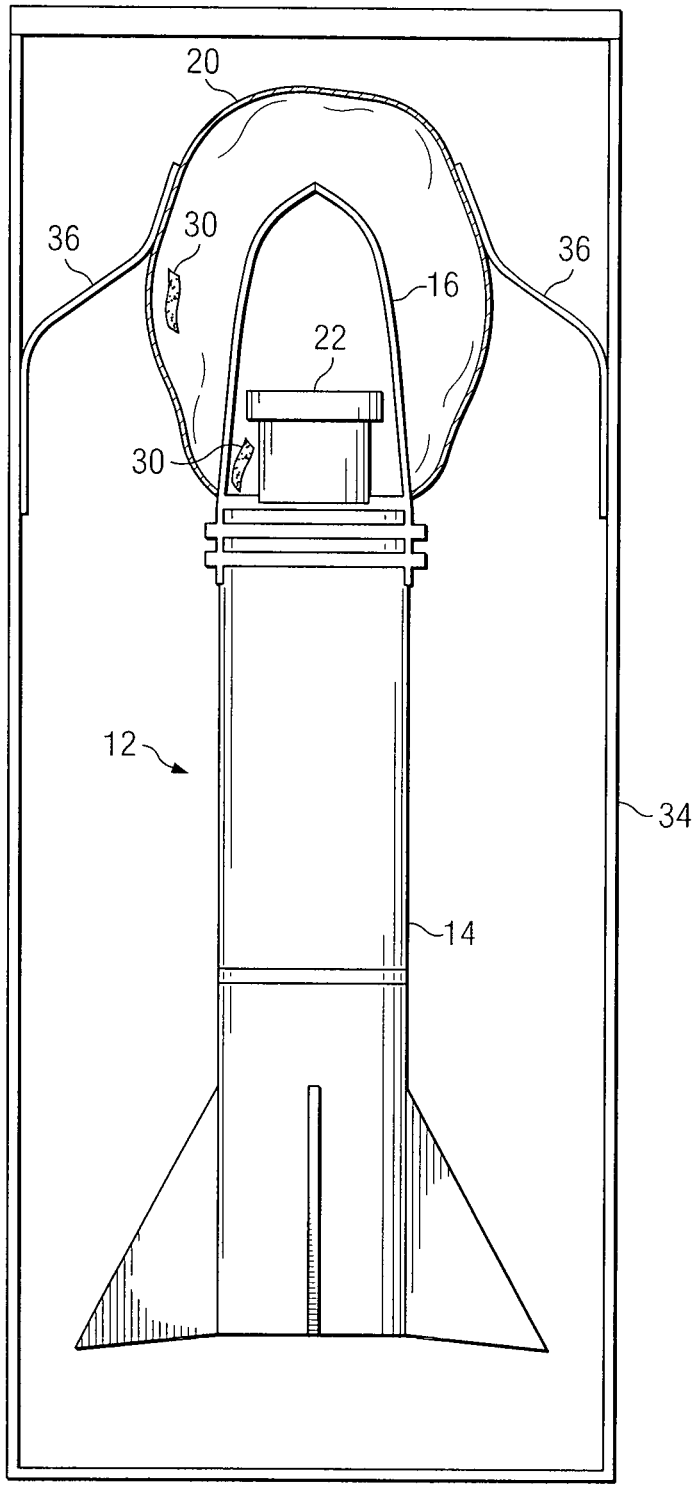
FIG. 4 is a side elevation, cross-sectional view of another embodiment in which a portion of a hermetic covering system bag is attached to a container in which a projectile is stored.

FIG. 4 is another embodiment of a hermetic covering system in which a portion of bag 20 is attached to a container 34. Container 34 may be any device that is used to house projectile 12 during storage, such as a container for missiles. In the particular embodiment shown, bag 20 is attached to container 34 using one or more straps 36. Using this approach, bag 20 may hermetically seal component 16 from the ambient environment while projectile 12 is stored in container 34. However, when launched, straps 36 will remain attached to container 34 causing bag 20 to be torn away from projectile 12.

Straps 36 may be made of several materials. In one embodiment, straps 36 are made of the same material as bag 20, just thicker. In other embodiments, straps 36 may be made of metal or synthetic compounds, such as Nylon. Straps 36 may be mechanically fastened to container 34. Straps 36 may also be adhesively bonded to bag 20. In one embodiment, straps 36 are formed as part of bag 20 in a manner such that straps 36 are stronger than either the bond between bag 20 and projectile 12 or bag 20 itself. Straps 36 may be attached to bag 20 in a location on bag 20 such that bag 20 is enabled to easily and cleanly tear away. In one embodiment, straps 36 are attached to bag 20 in a region on bag 20 that is intentionally weakened to allow a well defined break or tear. Such a region may be formed using a seam or joint or any other approach that will allow bag 20 to separate in that location.

Figure 5:
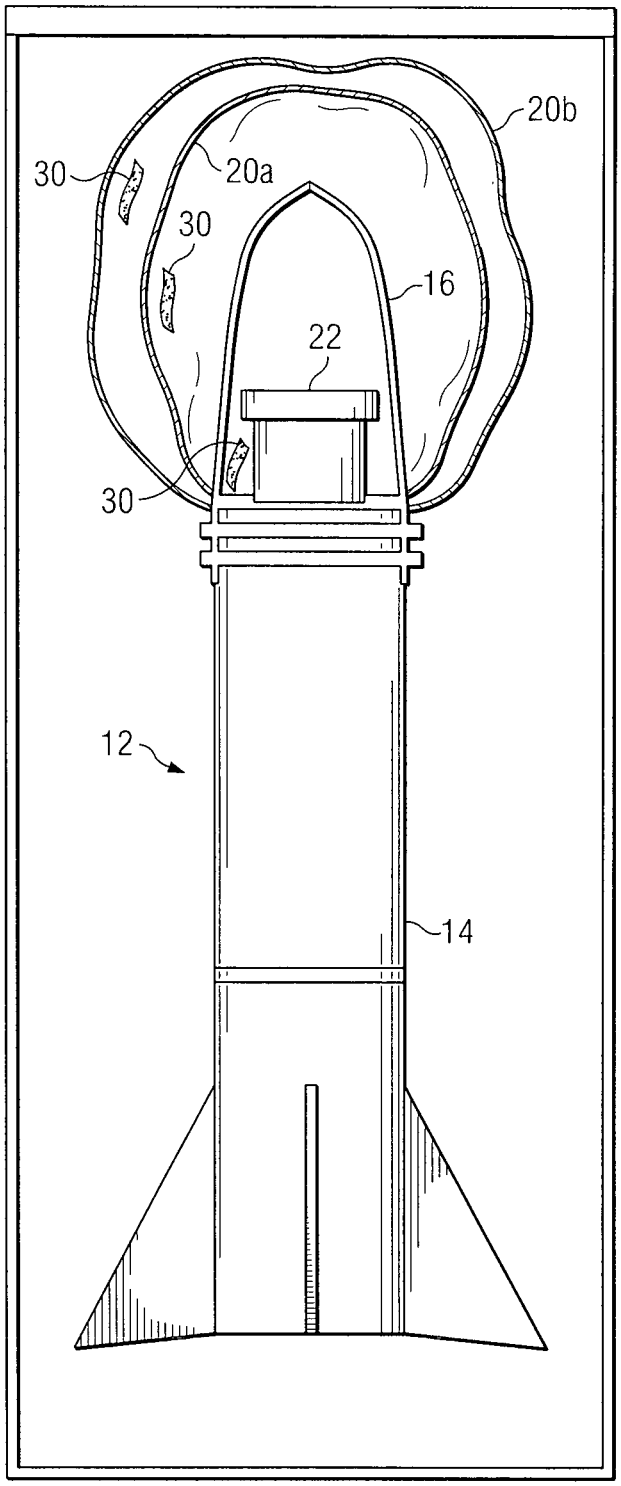
FIG. 5 is a side elevation, cross-sectional view of another embodiment in which a component that houses moisture-sensitive equipment is encased in two bags.

FIG. 5 is another embodiment of a hermetic covering system in which two bags 20*a* and 20*b* are implemented to hermetically seal component 16 from moisture. Bags 20*a* and 20*b* may provide an additional level of protection or redundancy for hermetic covering system 10. In one embodiment, bags 20*a* and 20*b* may each be made of a similar material. In another embodiment, bags 20*a* and 20*b* may each be made of a different material. For example, bag 20*a* may be made of metal foil and bag 20*b* may be made of metalized Mylar. Bag 20*a*, made of metal foil, may provide relatively good moisture resistance while bag 20*b*, made of metalized Mylar, may provide relatively good resistance against inadvertent tear during storage of projectile 12.

Figure 6:
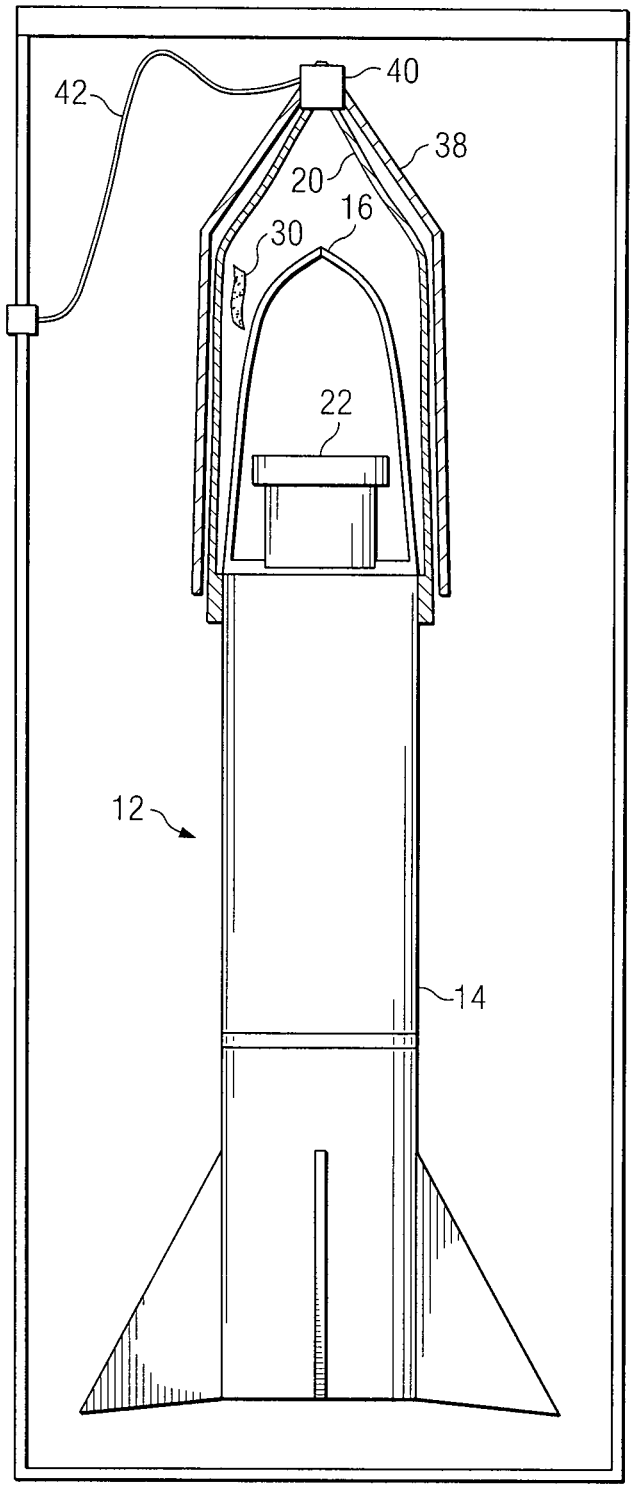
FIG. 6 is a side elevation, cross-sectional view of another embodiment in which a hermetic covering system bag is maintained in a generally fixed position in relation to a component that houses moisture-sensitive equipment using a rigid housing.

FIG. 6 is another embodiment of a hermetic covering system in which a generally rigid housing 38 is provided over bag 20. Rigid housing 38 may be made of an expendable material, such as Styrofoam, that may be easily torn from projectile 12 upon launch. Rigid housing 38 may be included to maintain bag 20 in a generally fixed position in relation to component 16. In one embodiment, a test instrument 40, such as a radio frequency sensor, may be attached to rigid housing 38. In another embodiment, test instrument 40 may also be coupled to cable 42 in order to communicate information. Test instrument 40 may be used to perform periodic maintenance tests of equipment 22, such as radio frequency circuitry, within component 16. In various embodiments, the shape of bag 20 may be formed using rigid housing 38 in a manner that directs RF energy to test instrument 40. For example, bag 20 may be shaped as a Waveguide Horn. In various embodiments, cable 42 could also be used as a mechanism to separate bag 20 and rigid housing 38 from projectile 12; for example, during launch, cable 42 could remain attached to a fixed structure thereby aiding in the separation of bag 20 and rigid housing 38 from projectile 12.

Particular embodiments of hermetic covering system 10 for projectile 12 have been described that may hermetically seal component 16 of projectile 12. Bag 20 may have a tear strength to withstand normal use during storage, yet may be easily torn away when the projectile is launched. Bag 20 may be made of various types of materials, such as materials that may facilitate periodic testing of equipment 22 within component 16. Thus, hermetic covering system 10 may provide generally good protection from moisture using relatively inexpensive materials.

Although several embodiments have been illustrated and described in detail, it will be recognized that substitutions and alterations are possible without departing from the spirit and scope of the appended claims.

What is claimed is:

1. A hermetic covering system, comprising:

a projectile having a body and a component housing moisture-sensitive equipment; and at least one bag having an opening and enclosing an inner cavity, the at least one bag hermetically sealed to the body such that the projectile protrudes through the opening and the component is disposed in the inner cavity to protect the component during storage of the projectile, and an inner surface of an innermost one of the at least one bag having a different shape and size from an outer surface of the body of the projectile at locations of the body defined forwardly from the opening.

2. The system of claim 1, further comprising a desiccant disposed in between the at least one bag and the component.

3. The system of claim 1, wherein the projectile is a missile.

4. The system of claim 1, wherein the component is a radome.

5. The system of claim 1, further comprising at least one sealed access cover on the at least one bag to provide access to the inner cavity.

6. The system of claim 1, wherein the at least one bag comprises a first bag and a second bag, and the first bag is the innermost one of the at least one bag and is disposed in a cavity of the second bag.

7. The system of claim 1, wherein the at least one bag comprises metal foil.

8. The system of claim 1, wherein the at least one bag comprises a radio frequency absorbing material selected to match an impedance of radio frequency equipment disposed in the component.

9. The system of claim 1, wherein the projectile is stored in a container, a portion of the at least one bag being attached to the container.

10. The system of claim 1, further comprising a generally rigid housing disposed over the at least one bag and configured to maintain the at least one bag in a generally fixed position relative to the component.

11. The system of claim 10, further comprising a sensor coupled to the generally rigid housing to communicate information associated with the moisture-sensitive equipment.

12. A hermetic covering method, comprising:

hermetically sealing at least one bag to a body of a projectile having a component housing moisture-sensitive equipment;

the at least one bag having an opening and enclosing an inner cavity;

coupling the at least one bag to the body at the opening such that the projectile protrudes through the opening and the component is disposed in the inner cavity to protect the component during storage of the projectile;

separating the at least one bag from an outer surface of the body of the projectile at locations of the body defined forwardly from the opening; and installing at least one sealed access cover on the at least one bag to provide access to the inner cavity.

13. The method of claim 12, further comprising disposing a desiccant between the at least one bag and the component.

14. The method of claim 12, wherein the projectile is a missile.

15. The method of claim 12, wherein the component is a radome.

16. The method of claim 12, wherein the coupling of the at least one bag to the body comprises coupling a first bag and a second bag to the body, the first bag disposed in a cavity of the second bag.

17. The method of claim 12, wherein the at least one bag comprises metal foil.

18. The method of claim 12, wherein the at least one bag comprises a radio frequency absorbing material selected to match an impedance of radio frequency equipment disposed in the component.

19. The method of claim 12, further comprising: storing the projectile in a container; and attaching a portion of the at least one bag to the container.

20. The method of claim 12, further comprising: disposing a generally rigid housing over the at least one bag; and configuring the generally rigid housing to maintain the at least one bag in a generally fixed position relative to the component.

21. The method of claim 20, further comprising coupling a sensor to the generally rigid housing to communicate information associated with the moisture-sensitive equipment.

22. The method according to claim 12, wherein the separating of the at least one bag from the outer surface of the body of the projectile comprises:

disposing the projectile in a container; and supporting the at least one bag at a distance from the outer surface with straps attached to the container.

23. A hermetic covering system, comprising:

a projectile having a body and a component housing moisture-sensitive equipment; and at least one bag having an opening and enclosing an inner cavity, the at least one bag hermetically sealed to the body such that the projectile protrudes through the opening and the component is disposed in the inner cavity to protect the component during storage of the projectile, and an entire inner surface of an innermost one of the at least one bag being separated at a distance from an entire outer surface of the body of the projectile at locations of the body defined forwardly from the opening.

* * * * *